US009908132B2

(12) United States Patent
Dalisay et al.

(10) Patent No.: US 9,908,132 B2
(45) Date of Patent: Mar. 6, 2018

(54) MECHANISM TO PREVENT ACTUATOR OF A PUMP DISPENSER TO PREMATURELY OPEN AND LEAK

(71) Applicant: The Procter & Gamble Company, Cincinnati, OH (US)

(72) Inventors: Huberto Miel Dalisay, Cincinnati, OH (US); Kenneth Eugene Lamb, Lebanon, OH (US); Robert Keith Morrissey, Carlisle, OH (US); William Peter Wurzelbacher, Hamilton, OH (US); Lin Tianda, Foshan (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/689,569

(22) Filed: Apr. 17, 2015

(65) Prior Publication Data

US 2016/0303600 A1 Oct. 20, 2016

(51) Int. Cl.
*B05B 11/00* (2006.01)

(52) U.S. Cl.
CPC ..... *B05B 11/306* (2013.01); *B05B 11/3052* (2013.01); *B05B 11/3047* (2013.01); *B05B 11/3059* (2013.01)

(58) Field of Classification Search
CPC ..... B05B 11/306; B05B 11/3052; B05B 11/3023; B05B 11/3074; B05B 11/3047; B05B 11/3053; B05B 11/3001; B05B 33/3097; B05B 33/3069
See application file for complete search history.

(56) References Cited

U.S. PATENT DOCUMENTS 3,237,571 A * 3/1966 Corsette ..... B05B 11/3023 222/321.9
3,362,344 A * 1/1968 Duda ..... B05B 11/3001 222/321.9
4,369,899 A * 1/1983 Magers ..... B67D 7/0211 222/153.13
4,371,099 A * 2/1983 Foster ..... B05B 11/3047 222/153.13
4,991,746 A 2/1991 Schultz
(Continued)

OTHER PUBLICATIONS

PCT International Search Report and Written Opinion for PCT/US2016/027779; dated Jul. 25, 2016; 10 pages.

*Primary Examiner* — Frederick C Nicolas
(74) *Attorney, Agent, or Firm* — Linda M. Sivik

(57) ABSTRACT

The present invention is directed to a dispensing pump for dispensing material from a container having a chaplet comprising a rotating ring and a stationary ring, wherein the rotating ring is connected to an actuator and the stationary ring is connected to an actuator assembly; a rotating ring affixed to the actuator wherein the rotating ring comprises a cut-out arc having an angle between about 45 degrees to about 345 degrees, wherein the remaining portion of the rotating ring is an uncut portion; a stationary ring attached to the actuator assembly a key protruding from the stationary ring which fits along the cut-out arc of the rotating ring; wherein the actuator rotates with the rotating ring until the uncut portion of the rotating ring is stopped by the key wherein the actuator starts to unscrew from the rotating ring until the actuator is released.

10 Claims, 4 Drawing Sheets

(56) References Cited

U.S. PATENT DOCUMENTS

| | | | | |
|---|---|---|---|---|
| 5,524,793 | A * | 6/1996 | O'Neill | G01F 11/028 222/153.13 |
| 5,715,973 | A * | 2/1998 | Foster | B05B 11/007 222/153.13 |
| 5,738,250 | A * | 4/1998 | Gillingham | B05B 11/0016 222/153.13 |
| 5,829,641 | A | 11/1998 | Bartsch et al. | |
| 6,230,942 | B1 * | 5/2001 | Kuo | B05B 11/0016 222/321.9 |
| 6,283,332 | B1 * | 9/2001 | Ragno | B05B 11/306 222/153.13 |
| 6,357,629 | B1 * | 3/2002 | Ding | B05B 11/306 222/153.13 |
| 6,364,167 | B1 * | 4/2002 | Safian | B05B 11/3047 222/153.13 |
| 6,604,656 | B1 * | 8/2003 | Tseng | B05B 11/306 222/153.13 |
| 7,854,351 | B2 * | 12/2010 | Bougamont | B05B 11/3059 222/153.13 |
| 8,403,181 | B2 * | 3/2013 | Ding | B05B 11/306 222/153.13 |
| 2011/0297700 | A1 | 12/2011 | Santagiuliana | |

* cited by examiner

MECHANISM TO PREVENT ACTUATOR OF A PUMP DISPENSER TO PREMATURELY OPEN AND LEAK

FIELD OF INVENTION

The present invention is direct to a dispensing pump comprising a mechanism to prevent an actuator of a pump to prematurely open or pop up and leak.

BACKGROUND OF THE INVENTION

Pump dispensers are well known in the personal care industry for dispensing fluid products such as liquids, creams or pastes. They generally include an actuator assembly with a nozzle connected to a pump assembly leading to a dip tube, which is inserted into the fluid product reservoir. The actuator assembly is typically fitted air tight to the mouth of the reservoir. Typically, the actuator assembly includes a piston, a spring and an inner valve (such as a ball). This enables the definition of a dose of the fluid product expelled out of the container through the nozzle on each pressing or actuation. To prevent unintended product dispensing, the actuator is secured to the closure by a chaplet until point of use.

Actuators on conventional pumps start to release as soon as rotated or are fully released at 90 degrees. This may result in the pump to prematurely pop up during handling, which can cause leaking of product or jamming of the packing line jam. Some solutions involve significant cost due to additional parts (e.g. overcaps) or secondary manipulations (shrink wrap).

The present invention relates to a pump dispenser with a chaplet, having a stationary ring and rotating ring assembly. The rotating ring has a cut out portion around the circumference. The cut out can be sized to dial in or control when the actuator starts to release and pop up when unscrewed/rotated.

It is the object of the present invention to provide a cost-effective solution by incorporating into a pump design, a mechanism for the actuator to rotate freely about 180 degrees to help prevent premature release and leaking.

SUMMARY OF THE INVENTION

The present invention is directed to a dispensing pump for dispensing material from a container comprising a chaplet comprising a rotating ring and a stationary ring, wherein the rotating ring is connected to an actuator and the stationary ring is connected to an actuator assembly; a rotating ring affixed to the actuator wherein the rotating ring comprises a cut-out arc having an angle between about 45 degrees to about 345 degrees, wherein the remaining portion of the rotating ring is an uncut portion; a stationary ring attached to the actuator assembly a key protruding from the stationary ring which fits along the cut-out arc of the rotating ring; wherein the actuator rotates with the rotating ring until the uncut portion of the rotating ring is stopped by the key wherein the actuator starts to unscrew from the rotating ring until the actuator is released.

DETAILED DESCRIPTION OF EMBODIMENTS OF THE INVENTION

All percentages and ratios used herein are by weight of the total composition, unless otherwise designated. All measurements are understood to be made at ambient conditions, where "ambient conditions" means conditions at about 25° C., under about one atmosphere of pressure, and at about 50% relative humidity (RH), unless otherwise designated. All numeric ranges are inclusive of narrower ranges; delineated upper and lower range limits are combinable to create further ranges not explicitly delineated.

All numerical amounts are understood to be modified by the word "about" unless otherwise specifically indicated. All such weights as they pertain to listed ingredients are based on the active level and do not include carriers or by-products that may be included in commercially available materials, unless otherwise specified.

Herein, "comprising" means that other steps and other ingredients which do not affect the end result can be added. This term encompasses the terms "consisting of" and "consisting essentially of". The compositions, methods, uses, kits, and processes of the present invention can comprise, consist of, and consist essentially of the elements and limitations of the invention described herein, as well as any of the additional or optional ingredients, components, steps, or limitations described herein.

Figure 1:
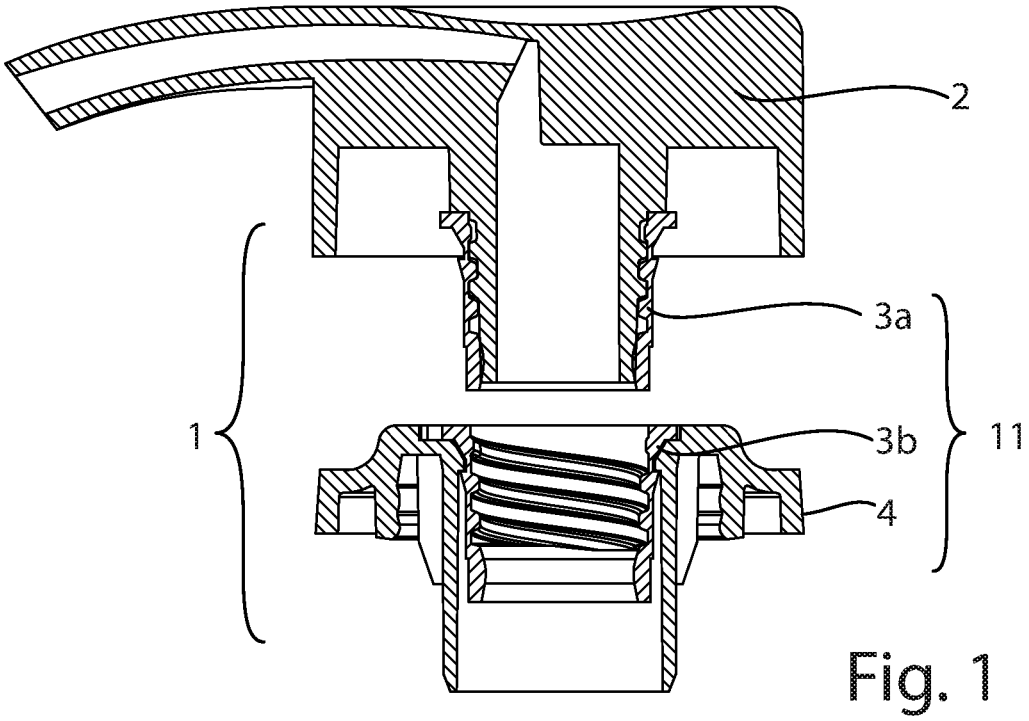
FIG. 1 is an actuator assembly (1) comprising an actuator (2) and a chaplet (11) of the present invention with a stationary ring (4) and a rotating ring (3*a*) threaded to actuator (2) and the outside cylindrical surface of the rotating ring (3*b*).

A dispensing pump with a two-piece chaplet (11) (FIG. 1)

The present invention is directed to a chaplet which is the part of the pump assembly that holds down the actuator (2) to the closure before it is released for dispensing. A chaplet is conventionally constructed of polypropylene and is cylindrical. The actuator (2) has an external channel through which the product is dispensed. The actuator assembly is the mechanism that pulls the product from the container via the dip tube and pushes it through the actuator. It consists of a spring, piston and ball assembly. When the actuator (2) is pushed downward, the product that accumulated in the piston is pushed up the actuator (2). It is blocked from returning to the container by the ball, which forms an airtight seal with the housing passage to the container. When the actuator (2) is released, the piston is pushed up by the spring, sucking up product from the container along the dip tube. The dip tube is a plastic stem that channels the suction from the pump assembly to the product reservoir.

Figure 2:
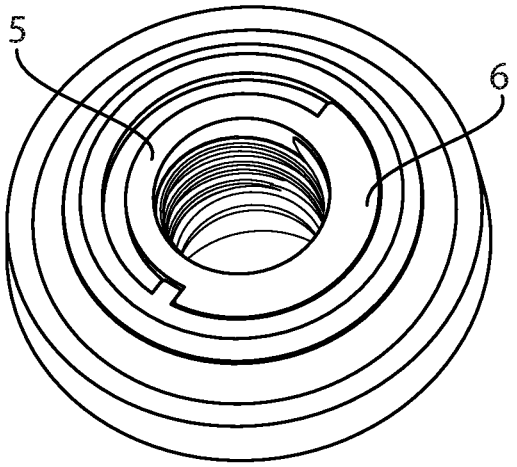
FIG. 2 is a two piece chaplet assembly of the present invention showing a cut-out portion of a rotating ring.
Figure 3:
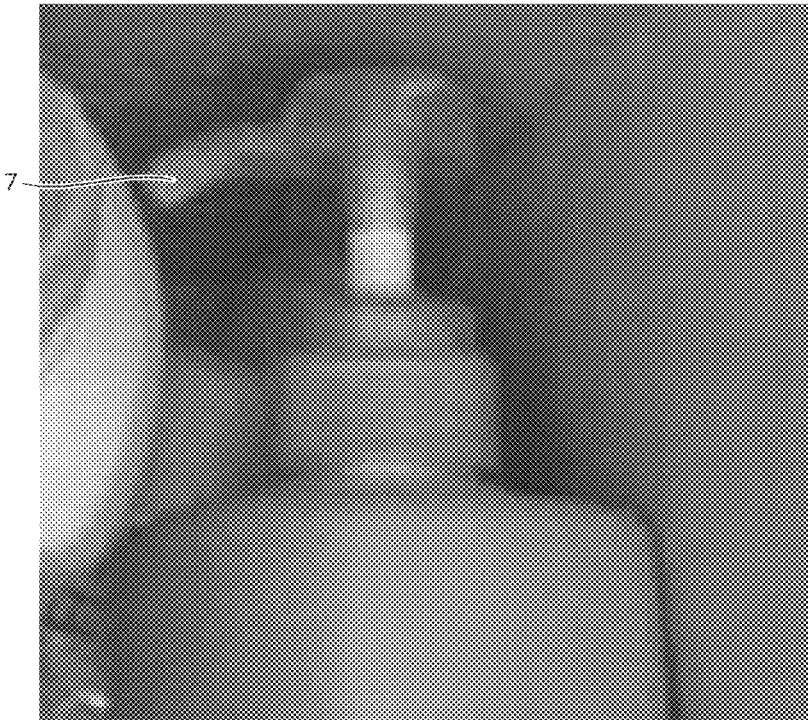
FIG. 3 is picture of product leaking due to premature release of the actuator during E commerce shipping.
Figure 4:
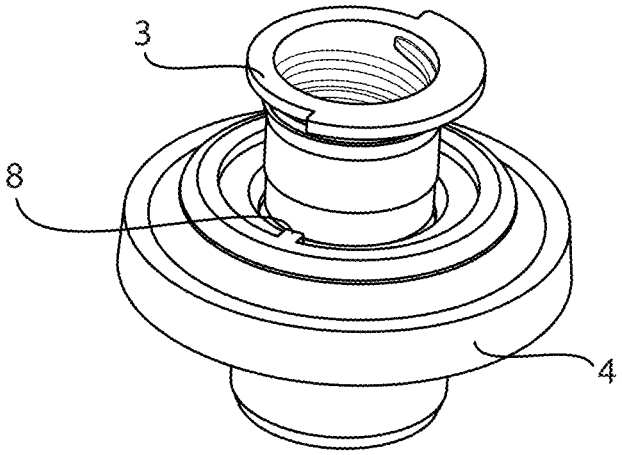
FIG. 4 is a two piece chaplet of the present invention wherein a rotation ring is snapped into a stationary ring with a key.

The 2-piece chaplet consists of a rotating ring and a stationary ring assembly (FIG. 1, FIG. 2 and FIG. 4)

The actuator (2) is screwed to the rotating ring (3). The rotating ring (3) is snapped into the stationary ring (4) (FIG. 4). The stationary ring (4) has a key (8), a protrusion from its surface that matches along the cut-out portion (5) of the rotating ring. As the actuator (2) is rotated, it remains attached to and moves with the rotating ring (3) until the uncut portion (6) of the rotating ring (3) is blocked by the key (8). The actuator (2) then starts to unscrew. For applications where it is advantageous to delay the actuator release (e.g. to prevent undesirable product dispensing during shipment, to avoid packing line jam), the cut out portion of the rotating ring can be sized or dialed appropriately, from 180 to about 345 degrees.

The 2-piece chaplet assembly has 2 possible constructions. In one design (FIG. 1), the rotating ring (3) is inside the stationary ring (4). The inner cylindrical surface of the rotating ring (3*a*) is threaded to actuator (2). The outside cylindrical surface of the rotating ring (3*b*) has the cut and un-cut portions of the circumference that intersects with the key (8) or protrusion from the stationary ring (4). It also has a thin bead that snaps into a matching groove of the stationary ring (4).

Figure 5:
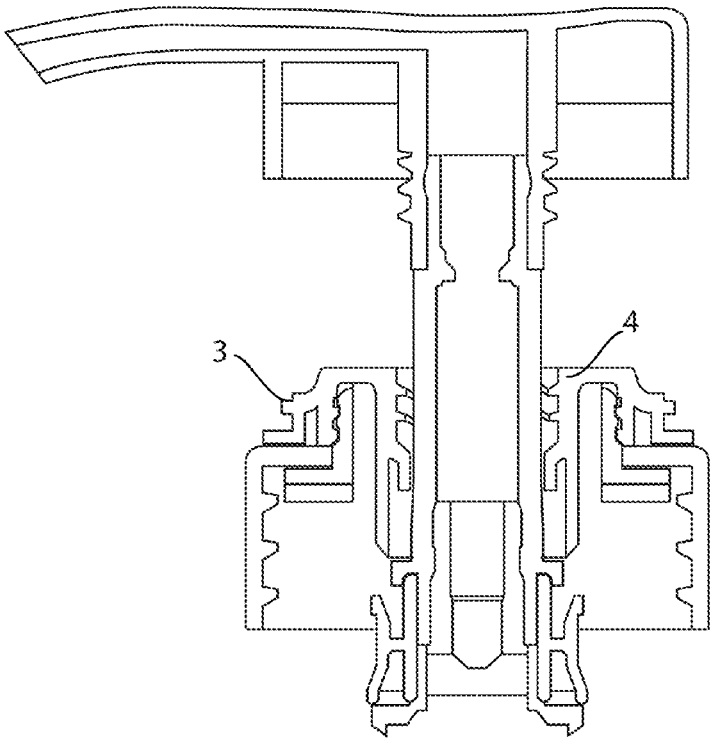
FIG. 5 is a pump configuration of the present invention wherein the rotating ring is outside the stationary ring.
Figure 6:
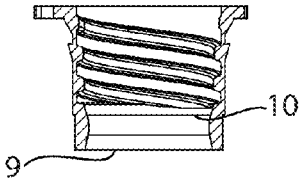
FIG. 6 is a pump configuration wherein additional product sealing is formed by a two-piece chaplet with an actuator stem.

In another design (FIG. 5), the rotating ring (3) is outside the stationary ring (4). The outer cylindrical surface of the rotating ring (3) is threaded to actuator (2). The inside cylindrical surface of the rotating ring (3) has the cut and un-cut portions of the circumference that intersects with the key (8) or protrusion from the stationary ring (4). It also has a groove that matches with a bead around the stationary ring (4).

The 2-piece chaplet may further prevent the product from leaking through the gap between the actuator stem and chaplet by creating an additional seal which prevents liquid from seeping but allows air for venting. Air venting is necessary to prevent forming a vacuum inside the bottle as the product is dispensed. This tortuous path consists of two, 180 degree bead rings, with an inner diameter of about 0.05 mm larger than the actuator stem. The 2 rings are offset by about 0.5 mm for venting.

The rotating ring (3) and stationary ring (4) can be made of various polyolefin grades, non-limiting examples include polyethylene, polypropylene, high-impact polypropylene, random polypropylene copolymer and mixtures thereof. Where improved impact resistance is needed, they are made of high-impact polypropylene.

The surface finishes of the chaplet stationary and rotating rings may be varied to enhance robustness of the functionality. The surface finish between the actuator and the rotating ring is unpolished, non-mirror to increase friction and help ensure engagement. The surface finish between the stationary and rotating ring is mirror finish to reduce friction and help ensure free rotation.

The cut and uncut portion of the circumference of the rotating ring may be varied to dial in the rotation before the actuator starts to release. By varying the cut portion of the rotating ring from 45 degrees to 345 degrees, the actuator will start to release at 45 degrees to 345 degrees of rotation, respectively.

Methods of Making

The stationary ring (4) and rotating ring (3) are made by conventional injection molding.They are then snapped together (FIG. 4) and then combined with the rest of the pump components using standard assembly process.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of Embodiments of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A dispensing pump for dispensing material from a container comprising:

a) a chaplet comprising a rotating ring and a stationary ring, wherein the rotating ring is connected to an actuator and the stationary ring is connected to an actuator assembly;

b) the rotating ring affixed to the actuator wherein the rotating ring comprises a cut-out arc having an angle between about 45 degrees to about 345 degrees, wherein the remaining portion of the rotating ring is an uncut portion;

c) a key protruding from the stationary ring which fits along the cut-out arc of the rotating ring;

wherein the actuator rotates with the rotating ring until the uncut portion of the rotating ring is stopped by the key wherein the actuator starts to unscrew from the rotating ring until the actuator is released.

2. A dispensing pump according to claim 1 wherein the cut-out arc of the rotating ring has an angle between sized from about 180 degrees to about 345 degrees.

3. A dispensing pump according to claim 1 wherein the cut-out arc of the rotating ring has an angle between sized from about 45 degrees to about 180 degrees.

4. A dispensing pump according to claim 1 wherein the rotating ring is inside the stationary ring.

5. A dispensing pump according to claim 1 wherein the rotating ring is outside the stationary ring.

6. A dispensing pump according to claim 1 wherein the rotating ring and/or stationary ring comprise polypropylenes, polyethylene, high impact polypropylene, random polypropylene copolymer and mixtures thereof.

7. A dispensing pump according to claim 1 wherein a surface finish of the rotating ring and/or stationary ring is an unpolished, non-mirror finish.

8. A dispensing pump according to claim 1 the surface finish of the rotating ring and/or stationary ring is a mirror finish.

9. A dispensing pump according to claim 1 wherein the surface finish of an outside surface of the rotating ring and an inside surface of the stationary ring is a mirror finish.

10. A dispensing pump according to claim 1 wherein the surface finish of an inside surface of the rotating ring and an outside surface of the actuator stem is an unpolished, non-mirror finish.

* * * * *